US006776110B2

(12) United States Patent
Fransing

(10) Patent No.: US 6,776,110 B2
(45) Date of Patent: Aug. 17, 2004

(54) APPARATUS FOR SEWING STITCH-GROUP SEAM PATTERNS

(75) Inventor: Heinz Fransing, Melle (DE)

(73) Assignee: Durkopp Adler Aktiengesellschaft (DE)

( * ) Notice: Subject to any disclaimer, the term of this patent is extended or adjusted under 35 U.S.C. 154(b) by 0 days.

(21) Appl. No.: 10/356,873

(22) Filed: Feb. 3, 2003

(65) Prior Publication Data

US 2003/0154894 A1 Aug. 21, 2003

(30) Foreign Application Priority Data

Feb. 16, 2002 (DE) ..... 102 06 477

(51) Int. Cl.[7] ..... D05B 75/06
(52) U.S. Cl. ..... 112/217.1
(58) Field of Search ..... 112/470.12, 470.17, 112/217.1, 217.2, 258; 108/103, 142, 104; 248/131

(56) References Cited

U.S. PATENT DOCUMENTS 680,660 A * 8/1901 Hug ..... 112/217.1
3,450,080 A * 6/1969 Klose ..... 112/217.2
4,116,146 A * 9/1978 Matthews ..... 112/217.2
4,296,696 A 10/1981 Taddicken et al.
4,436,042 A * 3/1984 Hanyu et al. ..... 112/217.1
4,685,408 A 8/1987 Frye
5,024,175 A * 6/1991 Epstein ..... 112/217.2
5,540,160 A * 7/1996 Rea ..... 112/217.2
6,536,362 B2 * 3/2003 Clarke ..... 112/217.2

OTHER PUBLICATIONS

English abstract only of Pub. No. 2000102682, pub. Nov. 4, 2000, Appln. No. 10275974, dated Sep. 29, 1998; Inventor: Igaraski Hirohide.
English abstract only of Pub. No. 06277378, pub. Apr. 10, 1994; Appln. No. 05068455, dated Mar. 26, 1993; Inventor: Kobayaski Akihiro.

* cited by examiner

*Primary Examiner*—Ismael Izaguirre
(74) *Attorney, Agent, or Firm*—James B. Conte; Barnes & Thornburg LLP

(57) ABSTRACT

An apparatus for sewing stitch-group seam patterns of a longitudinal direction that runs lengthwise or crosswise of an edge of a work piece comprises a table with a slab with an operator's side allocated thereto. Disposed on the slab is a bearing plate with a sewing machine resting thereon by its base plate. The slab is pivotable by a right angle between a first and a second working position and about a pivot bearing with an axis that is perpendicular to the slab. In this way, the position of the sewing machine relative to the operator's side is modifiable by a right angle.

6 Claims, 3 Drawing Sheets

APPARATUS FOR SEWING STITCH-GROUP SEAM PATTERNS

BACKGROUND OF THE INVENTION

1. Field of the Invention

The invention relates to an apparatus for sewing stitch-group seam patterns of a longitudinal direction that runs lengthwise or crosswise of an edge of a work piece.

2. Background Art

U.S. Pat. No. 4,296,696 describes an apparatus of the generic type, in which a sewing machine is mounted on a base part. The sewing machine includes an arm that is arranged below the stitch formation zone and a base plate that is arranged above the stitch formation area. The sewing machine is disposed on a carrier in the form of a triangular frame which is pivotable about a vertical axis that aligns with the needle bar and the needle. The sewing machine supports itself on the carrier by means of a displaceable guide arrangement. This apparatus is complicated and not appropriate for table-top sewing machines. Constructing the pivot axis is accompanied with considerable requirements.

SUMMARY OF THE INVENTION

It is an object of the invention to embody an apparatus of the generic type so that constructional requirements are reduced and handling is simplified.

According to the invention, this object is attained in an apparatus for sewing stitch-group seam patterns of a longitudinal direction that runs length-wise or crosswise of an edge of a work piece, comprising a table, which has a stand and a slab, and which an operator's side is allocated to; a sewing machine, which has a needle bar that is reciprocatingly drivable, a base plate, a lengthwise front, and a frontal end in vicinity to the needle bar; and a bearing plate, which rests on the slab, which the sewing machine rests on by its base plate, and which is pivotable between a first and a second working position about a pivot bearing with an axis that is perpendicular to the slab, wherein, in the first working position, the lengthwise front is turned towards the operator's side, and wherein, in the second working position, the frontal end is turned towards the operator's side. The sewing machine rests on a bearing plate which is again arranged on the table top pivotably about a pivot bearing—as a rule by approximately 90°. Requirements in terms of design and handling are extraordinarily low.

Details of the invention will become apparent from the ensuing description of an exemplary embodiment, taken in conjunction with the drawing.

DESCRIPTION OF THE PREFERRED EMBODIMENT

Figure 1:
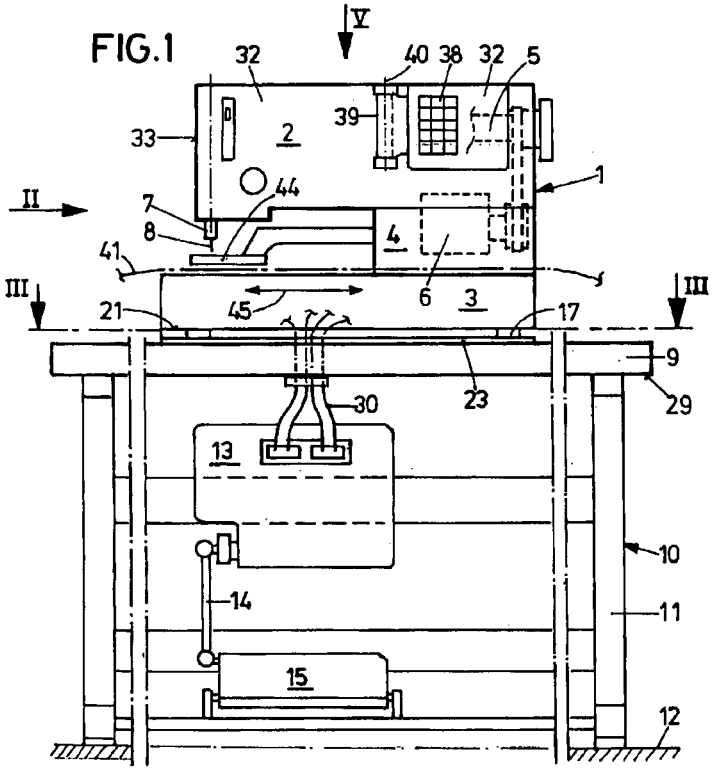
FIG. 1 is a lateral longitudinal view of the apparatus seen from the operator's side.
Figure 2:
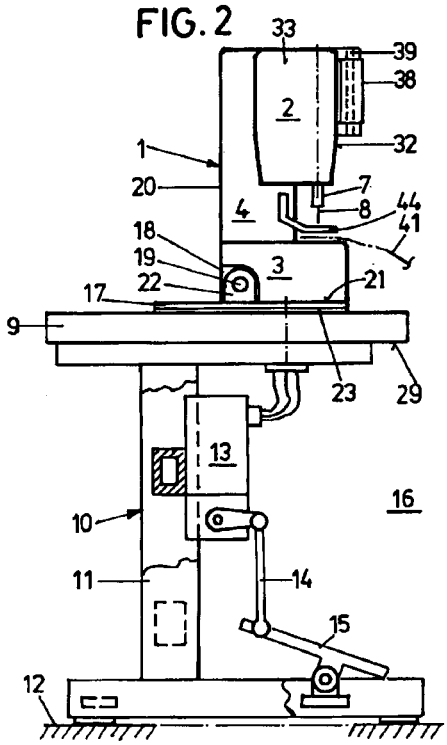
FIG. 2 is an elevation of the apparatus in accordance with the arrow II—II of FIG. 1.

A C-shaped sewing machine 1 includes a top arm 2, a base plate 3 of the type of a casing and a standard 4 that unites the arm 2 and the base plate 3. Disposed in the arm 2 is an arm shaft 5 (roughly outlined) which is drivable by a driving motor 6 (also roughly outlined). Conventionally, a needle bar 7 with a needle 8 is reciprocatingly driven by the arm shaft 5.

The sewing machine 1 is arranged on a slab 9 of a table 10 which supports itself by a stand 11 on the ground 12. A sewing-machine-1 control unit 13 is mounted on the stand 11; by way of a rod assembly 14 it is linked to a pedal 15. The pedal 15 can be actuated by an operator (not shown) from the operator's side 16.

The sewing machine 1 rests by its base plate 3 on a bearing plate 17, to which it is joined by a hinge 18, the rod-type bearing axis 19 of which runs approximately parallel to the arm shaft 5 i.e., in the longitudinal direction of the sewing machine 1. The bearing axis 19 horizontally adjoins the lengthwise rear 20 of the sewing machine 1 and the bottom side 21 of the base plate 3 by which it rests on the bearing plate 17. The hinge 18 is formed by two bearing blocks 22 that are tightly joined to the bearing plate 17 and by the bearing axis 19 that is lodged therein. The sewing machine 1 can be tilted about the bearing axis 19 of the hinge 18, with its lengthwise rear 20 tipping over towards the slab 9.

The bearing plate 17 is provided on its bottom side with a silencing and vibration-absorbent coating 23 of felt, by which it rests on the slab 9. Together with the sewing machine 1, the bearing plate 17 is displaceable on the slab 9. By means of a pivot bearing 24, the bearing plate 17 is mounted to be pivotable relative to the slab 9 about a vertical axis 25 i.e., about an axis 25 that is perpendicular to the slab 9. The pivot bearing 24 substantially comprises a tubular, hollow bearing journal 26 which is tightly joined to the bearing plate 17 by an annular flange 27 which is formed on the bearing journal 26 and by a nut 27*a* that is screwed thereon; the bearing journal 26 is lodged in a hole 28 of the slab 9. The bearing journal 26 is not secured on the bottom side 29 of the slab 9 i.e., it is merely inserted from above into the hole 28. The bearing plate 17 and the sewing machine 1 are secured on the slab 9 solely by their weight.

However, it is just as well possible to provide a securing ring on the bottom end of the bearing journal 26 i.e., underneath the bottom side 29 of the slab 9, so that positive fit is ensured between the sewing machine 1 and the table 10, in particular for conveyance of the apparatus in the direction of the axis 25.

The bearing journal 26 consists of plastic material and serves as a passageway, protected against wear, for pneumatic and/or electric lines 30 that lead through the bearing journal 26. Lines 30 of this type connect the control unit 13 to the sewing machine 1, mouthing into the base plate 3 thereof.

Figure 3:
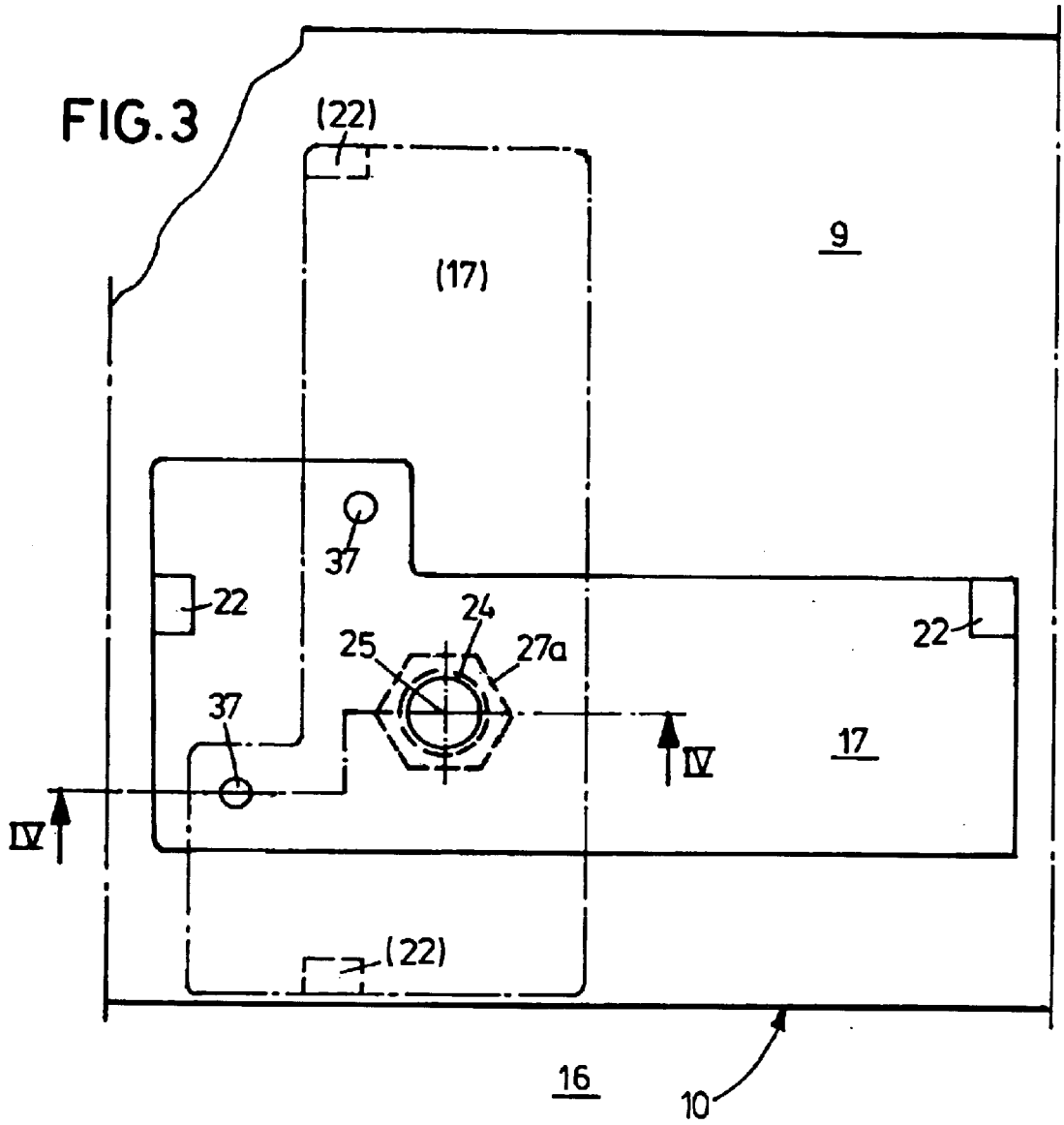
FIG. 3 is a horizontal section through the apparatus between the base plate of the sewing machine and the bearing plate on the line III—III of FIG. 1.
Figure 4:
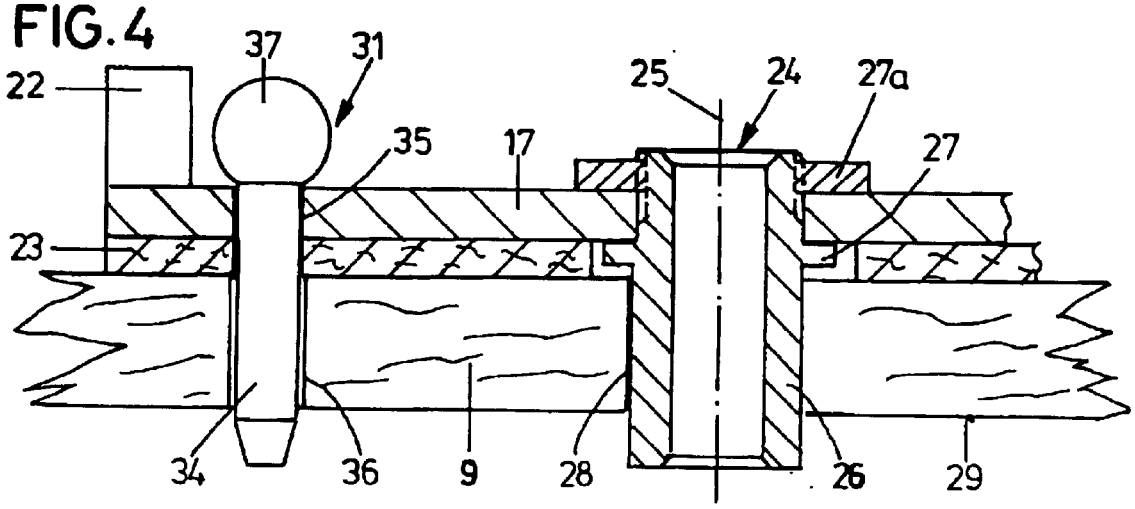
FIG. 4 is a vertical partial section through the apparatus on the line IV–IV of FIG. 3.

A detent 31 serves to arrest the bearing plate 17 on the slab 9 in two working positions that are turned by a right angle one relative to the other. As seen in FIG. 3, the sewing machine 1 can thus be fixed in two working positions relative to the operator's side 16, with its lengthwise front 32, in a first working position (shown in solid lines in FIG. 3), facing the operator's side 16 while, in a second working position (dashed in FIG. 3), the sewing-machine-1 frontal end 33 that adjoins the needle bar 7 with the needle 8 is turned towards the operator's side 16. The detent 31 is substantially comprised of a bolt 34 which reaches through a corresponding hole 35 in the bearing plate 17 and is alternately insertable into one of two holes 36 in the slab 9 that are allocated to the two working positions mentioned. The bolt 34 may have a thread. It has a handle head 37 on its upper end.

On the lengthwise front 32, a control panel 38 is articulated to the arm 2 for pivoting about a pivot joint 39 that has a vertical axis 40 and is disposed on the side, turned towards the needle bar 7, of the control panel 38.

Figure 5:
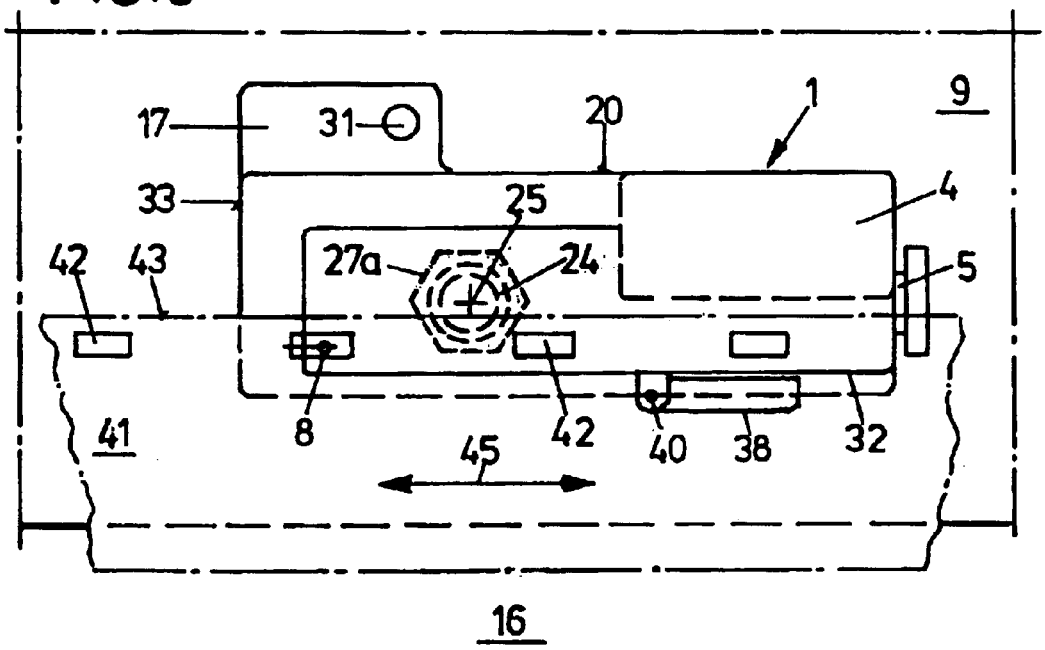
FIG. 5 is a plan view of the apparatus in a first working position of the sewing machine in accordance with the arrow V of FIG. 1.
Figure 6:
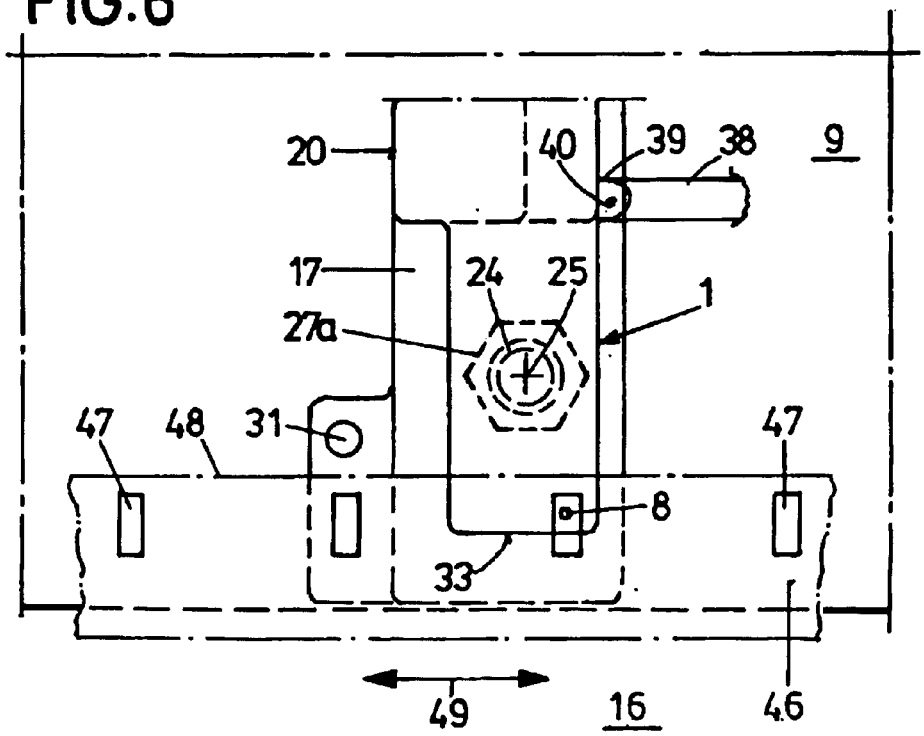
FIG. 6 is an illustration, corresponding to FIG. 5, showing a second working position of the sewing machine.

FIGS. 5 and 6 illustrate the two fields of application of the sewing machine. A work piece 41 is provided with sewing patterns comprised of stitch groups, for example button holes or stay stitches, several of which are sewn at a distance from each other.

In the case of a sewing-machine-1 arrangement according to FIG. 5, buttonholes 42, which are lined up in a row, are sewn one after the other with their lengthwise direction parallel to the operator's side 16 and to the edge 43 of the work piece 41. The buttonholes 42 are oriented longitudinally and lined up successively. For each individual buttonhole 42 to be sewn, the work piece 41 is held and guided on the base plate 3 by means of a work-piece holder 44. After each buttonhole-42 sewing job, work-piece feed takes place parallel to the lengthwise front 32 and parallel to the operator's side 16 in the work-piece-feed direction 45. The lengthwise front 32 of the sewing machine 1 is turned towards the operator's side 16. The control panel 38 is folded down on the arm 2 for visibility and operability from the operator's side 16.

In the mode of operation seen in FIG. 6, the frontal end 33 of the sewing machine 1 is turned towards the operator's side 16; the sewing machine 1, inclusive of the bearing plate 17, is rotated by 90° as compared to the working position seen in FIG. 5 and, in this position, locked in place on the slab 9. Buttonholes 47 are sewn in the work piece 46, which are arranged crosswise of the work-piece-feed direction 49 and consequently crosswise of the edge 48 of the work piece 46. They line up successively in a row, however with their longitudinal direction crosswise of the work-piece-feed direction 49. The longitudinal direction of each buttonhole 47 is parallel to the lengthwise front 32 of the sewing machine 1 i.e., the sewing job itself on the sewing machine 1 takes place in the same way as with the mode of operation according to FIG. 5. For visibility and operability of the control panel 38 from the operator's side 16, the control panel 38 is pivoted in a direction towards the needle bar 7 into a position turned by 90° as compared to FIG. 5; in this position, the control panel 38 stands out from the sewing machine 1 crosswise of the lengthwise front 32.

As the operator's side 16 finds itself without modification relative to the table 12 and the pedal 15, there is no need of modifying the pedal 15. The position of the pivot bearing 24 and the axis 25 is selected such that, in both working positions of the sewing machine 1 seen in FIGS. 5 and 6, an operator may conveniently keep his place in front of the sewing machine 1 and the table 10. Suitably, the pivot bearing 24 is also in the proximity of the needle-bar axis, which can easily be put into practice in the specified design.

What is claimed is:

1. An apparatus for sewing buttonhole seam patterns of a longitudinal direction that is one of lengthwise or crosswise of an edge (43, 48) of a work piece (41, 46), comprising a table (10),
- which has a stand (11) and
- a slab (9), and
- which an operator's side (16) is allocated to;

a sewing machine (1),
- which has one needle bar (7) that is reciprocatingly drivable,
- a base plate (3),
- a lengthwise front (32), and
- a frontal end (33) in vicinity to the needle bar (7);

a bearing plate (17),
- which continuously rests by it's full surface on the slab (9),
- which the sewing machine (1) rests on by its base plate (3), and
- which is displaceable by a right angle between a first and a second working position about a pivot bearing (24) with an axis (25) that is perpendicular to the slab (9),
  - wherein, in the first working position, the lengthwise front (32) is turned towards the operator's side (16), and
  - wherein, in the second working position, the frontal end (33) is turned towards the operator's side (16);

an absorption coating (23),
- which is disposed between the bearing plate (17) and the slab (9), and
- which is made of felt; and a detent (35),
- which arrests the bearing plate (17) in the first working position and the second working position,
- which comprises a bolt (34),
  - which is insertable in holes (35, 36) in the bearing plate (17) and the slab (9).

2. An apparatus according to claim 1, wherein the pivot bearing (24) comprises a bearing journal (26) which is joined to the bearing plate (17) and which is pivotably lodged in a hole (28) of the slab (9).

3. An apparatus according to claim 1, wherein the bearing plate (17) is secured solely by weight in the pivot bearing (24).

4. An apparatus according to claim 1, wherein the pivot bearing (24) is a passageway for lines (30).

5. An apparatus according to claim 4, wherein the pivot bearing (24) is a tube.

6. An apparatus according to claim 4, wherein the lines (30) mouth into the slab (3).

* * * * *